United States Patent [19]

Ross

[11] 4,019,547

[45] Apr. 26, 1977

[54] CAN FILLING METHOD AND APPARATUS

[75] Inventor: Edward E. Ross, San Rafael, Calif.

[73] Assignee: Del Monte Corporation, San Francisco, Calif.

[22] Filed: Mar. 22, 1976

[21] Appl. No.: 669,327

Related U.S. Application Data

[63] Continuation of Ser. No. 469,089, May 13, 1974, abandoned, which is a continuation-in-part of Ser. No. 366,414, June 4, 1973, abandoned.

[52] U.S. Cl. ..... 141/11; 53/24; 53/126; 141/69; 141/81; 141/198; 222/196

[51] Int. Cl.[2] ..... B65B 1/08

[58] Field of Search ..... 53/24, 124 D, 126; 100/265; 141/11, 12, 69, 81, 71–74, 131, 138–143, 153, 192, 180, 198, 256, 324, 331–334, 337–343; 222/196, 200; 259/5, 19, 21

[56] References Cited

UNITED STATES PATENTS

| | | | |
|---|---|---|---|
| 947,932 | 2/1910 | Peckham | 222/200 |
| 2,763,418 | 9/1956 | Hill | 141/180 X |
| 2,953,282 | 9/1960 | Peterson | 222/196 |
| 3,404,742 | 10/1968 | Bonneric | 141/71 X |
| 3,585,774 | 6/1971 | Rowell et al. | 53/24 X |
| 3,693,672 | 9/1972 | Hiland | 141/12 X |

*Primary Examiner*—Richard E. Aegerter
*Assistant Examiner*—Frederick R. Schmidt
*Attorney, Agent, or Firm*—Flehr, Hohbach, Test, Albritton & Herbert

[57] ABSTRACT

A method for filling containers with predetermined amounts of food material (e.g., leafy vegetable, like fresh blanched spinach). It employs a vertically extending tube having removable cut-off means at its lower end. The food material is supplied to the upper end of the tube in loose uncompacted form, and as it moves downwardly into the tube a column of the material is formed which provides progressively increased gravity compaction toward the lower end of the tube. Lower end portions of this column are recurrently cut off and caused to be transferred to containers being filled. Also apparatus for carrying out the method including the vertical tube into which the material is fed and having cut-off means at its lower end. Also, means is provided for continuously shaking the tube with a vertically directed stroke.

15 Claims, 9 Drawing Figures

CAN FILLING METHOD AND APPARATUS

CROSS REFERENCE TO RELATED APPLICATIONS

This application is a continuation of application Ser. No. 469,089 filed May 13, 1974 (now abandoned), which in turn was a continuation-in-part of application Ser. No. 366,414, filed June 4, 1973 (now abandoned).

BACKGROUND OF THE INVENTION

This invention relates generally to methods and apparatus to be used in food processing plants for filling containers with food materials.

The canning of certain food materials, such as spinach, involves a number of difficult and unusual requirements. The customary procedure is to introduce the spinach into cans immediately after blanching and before sealing and heat processing. This requires close weight control of each container. Generally the lower fill weight limit must be such as to meet minimum weights to comply with the governmental standards. The upper weight limit is important for economic reasons, and also because a weight less than an upper limit is of importance in assuring product sterility and safety after heat processing. After spinach has been blanched, it is difficult to handle and does not have uniform volume to weight ratios. The material is wet and limp as a result of blanching. Thus it does not lend itself to handling by mechanical filling machines where it is necessary for the material to have a relatively fixed volume-to-weight ratio.

Because of the foregoing, spinach is universally introduced into cans by manual labor. In such manual operations it is necessary to perform the collective functions of sorting the material for quality, manually introducing the material into the cans, and then checking the weight of each container. If the can is underweight then additional material must be added, or if it is overweight some must be removed. The labor productivity in such operations is relatively low, seldom exceeding five one-pound cans per minute per laborer.

Insofar as applicant is aware, no method or apparatus has been available to the canning industry for filling cans with measured amounts of spinach or like leafy vegetable, and which is capable of carrying out such operations in an efficient and automated manner, without manual labor.

Many other materials likewise present similar can-filling problems, including such leafy vegetables as cabbage, kale and collard greens which become limp when blanched. Also certain vegetables that are stringy and tend to be fluffy, when fresh or after blanching, such as green beans sliced lengthwise, sauerkraut (sliced cabbage), and shoestring carrots and beets, present some of the same problems.

In some instances, the maintenance of fixed volume-to-weight ratios is important although the material may not be leafy or stringy. An example is the canning of peaches or like fruit which is introduced into cans in particulate form with insufficient syrup to fill the voids.

SUMMARY OF THE INVENTION AND OBJECTS

It is an object of the invention to provide a method for filling cans or like receptacles with food materials which makes possible a relatively high degree of accuracy with respect to weight requirements.

Another object of this invention is to provide a container-filling method which will supply the material to the container with a predetermined degree of compaction and a relatively uniform volume-to-weight ratio, whereby a mass of the material of predetermined dimensions as supplied to the container provides a desired weight.

Another object of the invention is to provide a method of the above general character which will maintain a desired degree of compaction of the material for successive filling operations.

Another object is to provide a container-filling method which is well adapted for use with leafy vegetables like spinach, or vegetables of a stringy character.

Another object is to provide apparatus for carrying out the foregoing method in an automated manner.

The present method makes use of a vertically extending tube having cut-off means at its lower end. The food material is continuously supplied to the upper end of this tube and is caused to progress downwardly by gravity to provide a column of the material of predetermined height. The material within this column is subjected to gravity compacting pressure which increases toward the lower end. Lower end portions of this column are recurrently cut off and introduced into the containers. Also apparatus for carrying out the method, the apparatus including the vertical tube together with means for feeding the material into the upper end. Preferably means is provided which shakes the tube in such a manner as to facilitate downward movement of the material.

Additional objects and features of the invention will appear from the following description in which the preferred embodiment has been set forth in detail in conjunction with the accompanying drawings.

DETAILED DESCRIPTION OF PREFERRED EMBODIMENTS

Figure 1:
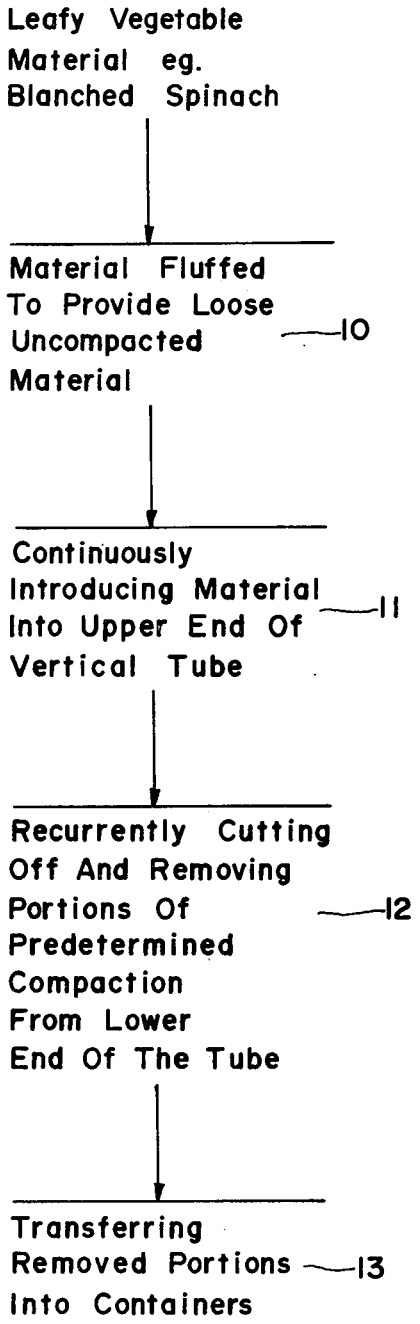
FIG. 1 is a flow diagram illustrating steps in the method.

FIG. 1 shows one form of the invention which is particularly adapted for filling containers with a leafy or stringy vegetable. It will be described in connection with processing blanched spinach.

The steps of the method as generally outlined in FIG. 1 consist in continuously supplying fresh blanched spinach to the step or operation 10 where the material is mechanically acted upon to loosen the same. This can be described as a fluffing operation which breaks up compacted masses of material and separates the individual leaves. In step 11 the material from this fluffing operation is continuously introduced into the upper end of a vertical tube. The material forms a column of predetermined height within this tube, and due to gravity progressive compaction occurs with the compaction increasing toward the lower end of the column. The degree of compaction toward the lower end of the tube depends upon the height of the column which, in practice, is maintained substantially constant during continuous automated operation. In step 12, successive portions of this column at the lower end of the tube, which are of predetermined dimensions, are cut off and transferred in step 13 to containers.

Figure 2:
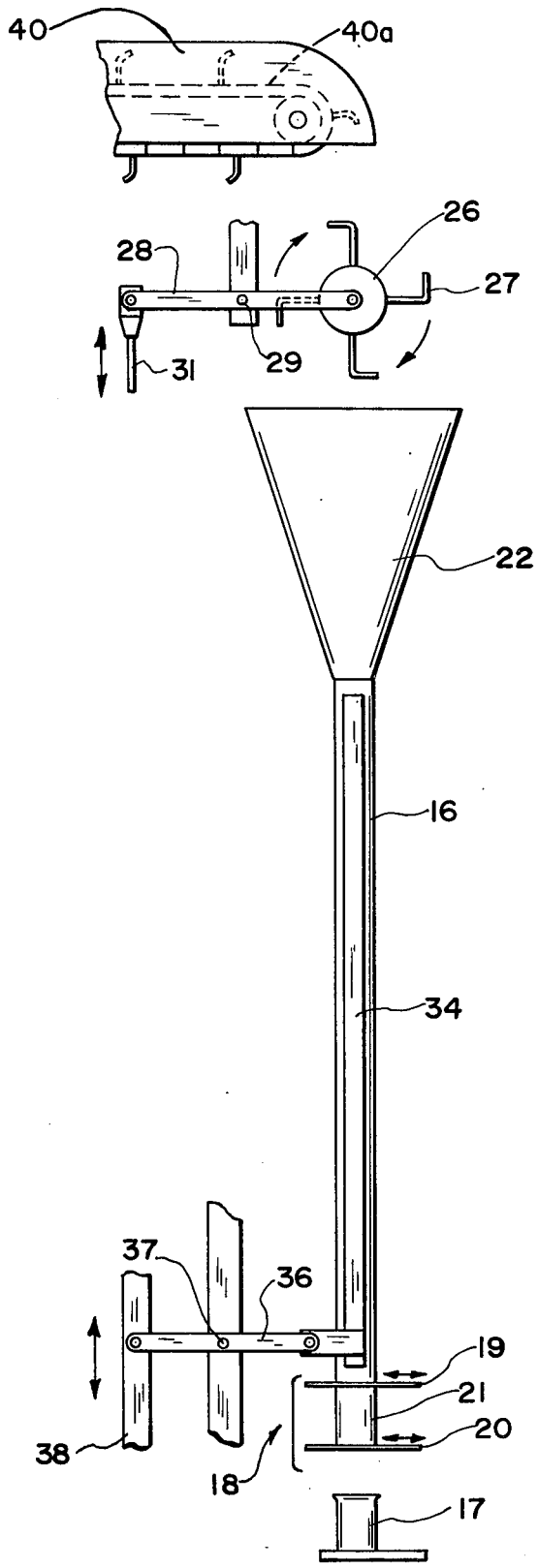
FIG. 2 is a schematic view illustrating apparatus for carrying out the method.

The apparatus schematically illustrated in FIG. 2 consists of the vertical tube 16 which at its lower end has a diameter equal or slightly less than the internal diameter of the cans 17 or other containers which are to be filled. For example, if the cans to be filled have an internal diameter of about 3 inches, then the tube can be about 1/16 inch less in internal diameter. The height of the tube may vary depending upon conditions, although in practice good results have been obtained by using a tube having a height of about 5 feet, where the material being handled is fresh blanched spinach. A column of material at least about 2 feet high is deemed necessary to obtain some compaction.

At the lower end of the tube suitable means 18 is provided for recurrently cutting off lower portions of the compacted column to provide masses of predetermined dimensions for introduction into a container 17. As schematically illustrated this means may include the power operated cut-off knife 19 and the closure plate 20, both of which operate adjacent the ends of the filler pocket 21. The upper end of the tube is provided with a hopper 22 for receiving material.

The means schematically illustrated in FIG. 2 for performing a fluffing operation upon incoming material consists of a rotary fluffing drum 26. This drum carries a plurality of hook or claw shaped members 27, which are spaced both circumferentially and axially and which may vary in length. Suitable drive means (not shown) serves to rotate the fluffing drum in the direction indicated.

It is desirable to subject the drum 26 to continuous shaking action with movement in a vertical direction. Thus the drum is shown journalled to the arms of levers 28 which have fixed pivotal mountings 29 to the frame of the machine. The levers are connected to rods 31 which extend to suitable eccentrics or other shaking devices.

Means is also provided for shaking the tube 16 to cause the column of spinach to move downwardly through the tube with a minimum of friction. Thus the tube is shown fixed to side members 34 which in turn are connected to the arms of the levers 36. These levers have fixed pivots 37 to the frame of the machine and are shown connected to a bar 38 connected to eccentric or other shaking means. By applying continuous shaking forces to the tube 16 with the stroke being in a vertical direction, the column of spinach moves freely downwardly through the tube, whereby compaction in the lower part of the tube is due completely to gravitational effects. In practice similar shaking levers can be connected to the upper ends of members 34.

The incoming spinach or other leafy material is fed continuously to the fluffing drum 26. The conveying means 40 schematically illustrated for this purpose may consist of a continuously driven flighted conveyor **40*a*** and is of the metering type.

Operation of the apparatus shown in FIG. 2 to carry out the method of FIG. 1 is as follows. The conveyor 40 is operated continuously, fluffing drum 26 is continuously rotated, and the tube 16 is continuously subjected to shaking action with a vertical stroke. As the freshly blanched spinach is supplied at a generally constant rate by the metering conveyor **40*a* and dropped down upon the rotating fluffing drum 26, the material is mechanically broken up and separated and the fluffed uncompacted material is permitted to drop by gravity into the hopper 22, from which it moves downwardly into the tube 16. As a column of the material collects within the tube 16, the lower part of the column is subjected to gravitational compaction, and assuming that the tube 16 is nearly filled with material, the gravity compaction of the material in the lower portion of the tube is at its maximum value. The compaction of the material at the lower end of the column is in direct ratio to the height of the column. Assuming that the height of the column of material is maintained substantially constant as the apparatus is in use, then the weight-to-volume ratio at the lower end of the column remains constant, and of a predetermined value. The cut-off blade 19 is continuously actuated or rotated during operation, and the cut-off action is in synchronism with movements of the closure plate 20. Thus starting with closure 20 closed and the blade 19 retracted, the lower portion of the column of material moves into the filler pocket 21. The inner cylindrical surface of this pocket is of the same diameter as that of the tube or slightly larger. Operation of the cutting blade 19 severs this lower portion of the column, and removal of the closure 20 immediately thereafter permits this severed portion to drop down into the container 17. Assuming that these cut-off and transfer operations are carried out continuously at a proper rate consistent with the metered rate of feed of blanched leafy material by the conveyor 40, then the column within the tube 16 can be maintained at a substantially constant height to maintain a substantially constant degree of compaction, and this in turn results in filling the containers 17** with a predetermined weight of material.

Figure 3:
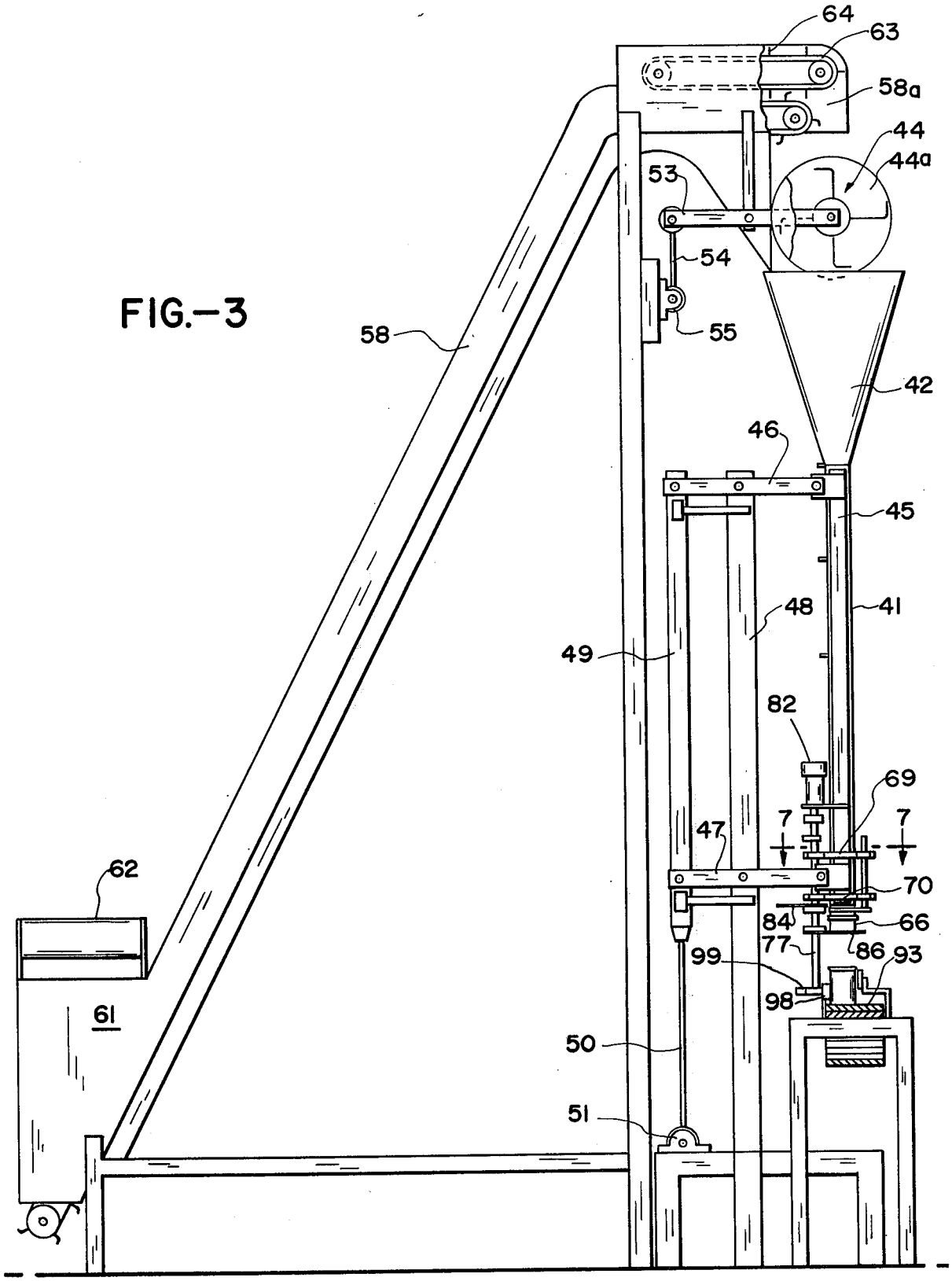
FIG. 3 is a side elevational view showing further details of one embodiment of the apparatus.
Figure 4:
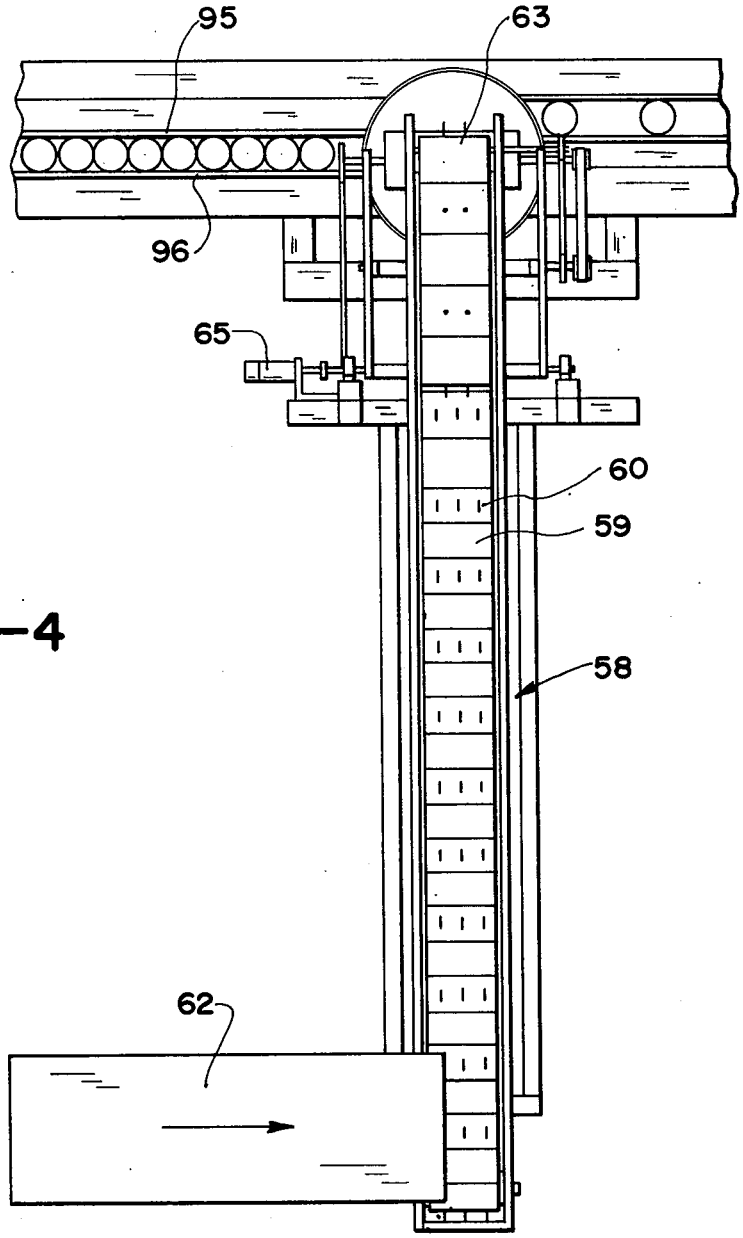
FIG. 4 is a plan view of the apparatus shown in FIG. 3.
Figure 5:
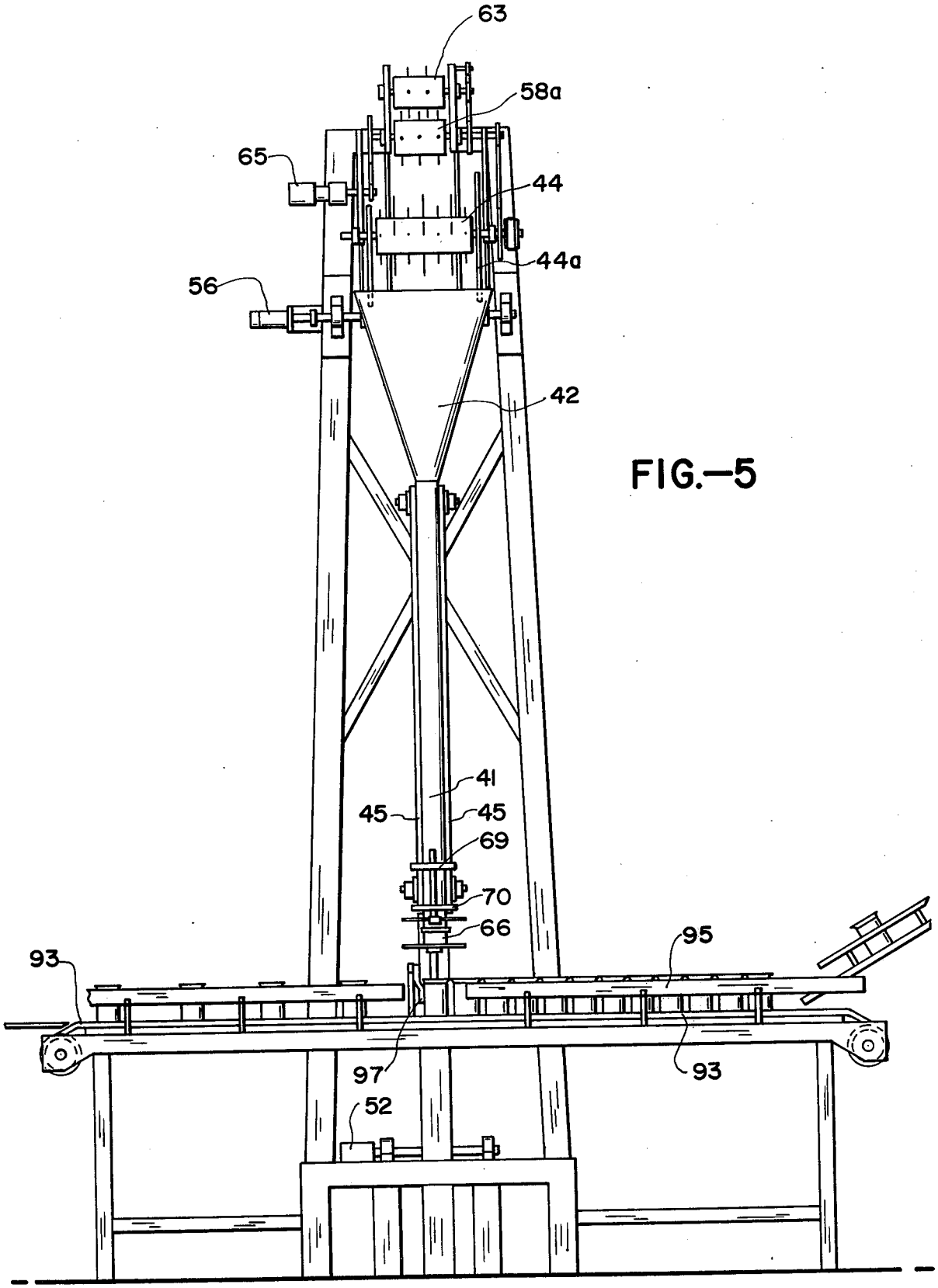
FIG. 5 is a front view looking toward the right hand end of the apparatus shown in FIG. 3.

FIGS. 3 – 7 illustrate further details of one embodiment of the apparatus. In this instance the tube 41 (corresponding to the tube 16 of FIG. 1) is provided with the upper hopper 42. The fluffing drum 44 above the hopper 42 is provided with annular guards or shields **44*a* to confine the fluffing region. The tube 41 is secured to the side members 45 which may be in the form of structural steel channels. The shaking levers 46 and 47 are pivotally connected to the side members 45 and are pivotally carried by the vertical frame member 48. Their other ends are interconnected by the weighted bar 49 which in turn is connected by rod 50 to the eccentric means 51 that is driven by suitable means such as motor 52 (FIGS. 3 and 5). The shaft of the fluffing drum 44 is journalled to the arms of levers 53. These levers are pivotally carried by a frame member of the machine, and their other ends are connected by rods 54 with the eccentrics 55 driven by motor 56 (FIGS. 3 and 5**).

The metering feed conveyor 58 has its main portion inclined as illustrated, and its upper portion **58*a* disposed to deliver the material upon the fluffing drum 44. As indicated (FIG. 4) this metering conveyor is of the flighted type comprising linked slats 59, some of which, or all, are provided with claw shaped members 60. The lower portion of the conveyor 58 is provided with a feed bin 61 into which material is introduced by conveyor 62. With this type of inclined feed conveyor, material is supplied to the fluffer 44 at a substantially constant rate. Preferably an assist discharge or rakeoff conveyor 63 overlies the discharge portion of the conveyor 58 (FIG. 3) and may be of the endless belt or slat type provided with claws or spikes 64. It is driven faster than conveyors 58 (e.g., twice as fast) by suitable drive means including motor 65 (FIG. 4**).

The filler pocket 66 (FIGS. 3 and 6) has an inner cylindrical surface having a diameter corresponding to the diameter of the tube 41. It is shown being carried by clamping ring 67 which in turn is secured to the mounting rod 68. Preferably pocket 66 is made of two telescoping parts **66*a* and 66*b* to permit the length of the pocket to be adjusted. The mounting rod 68 is secured to the vertical members 45 by the rectangular frame structures 69 and 70. Two members of each of these structures are secured to the vertical members 45 as by welding, and adjustable clamps 71 and 72 serve to secure the rod to the structures 69 and 70**.

Figure 6:
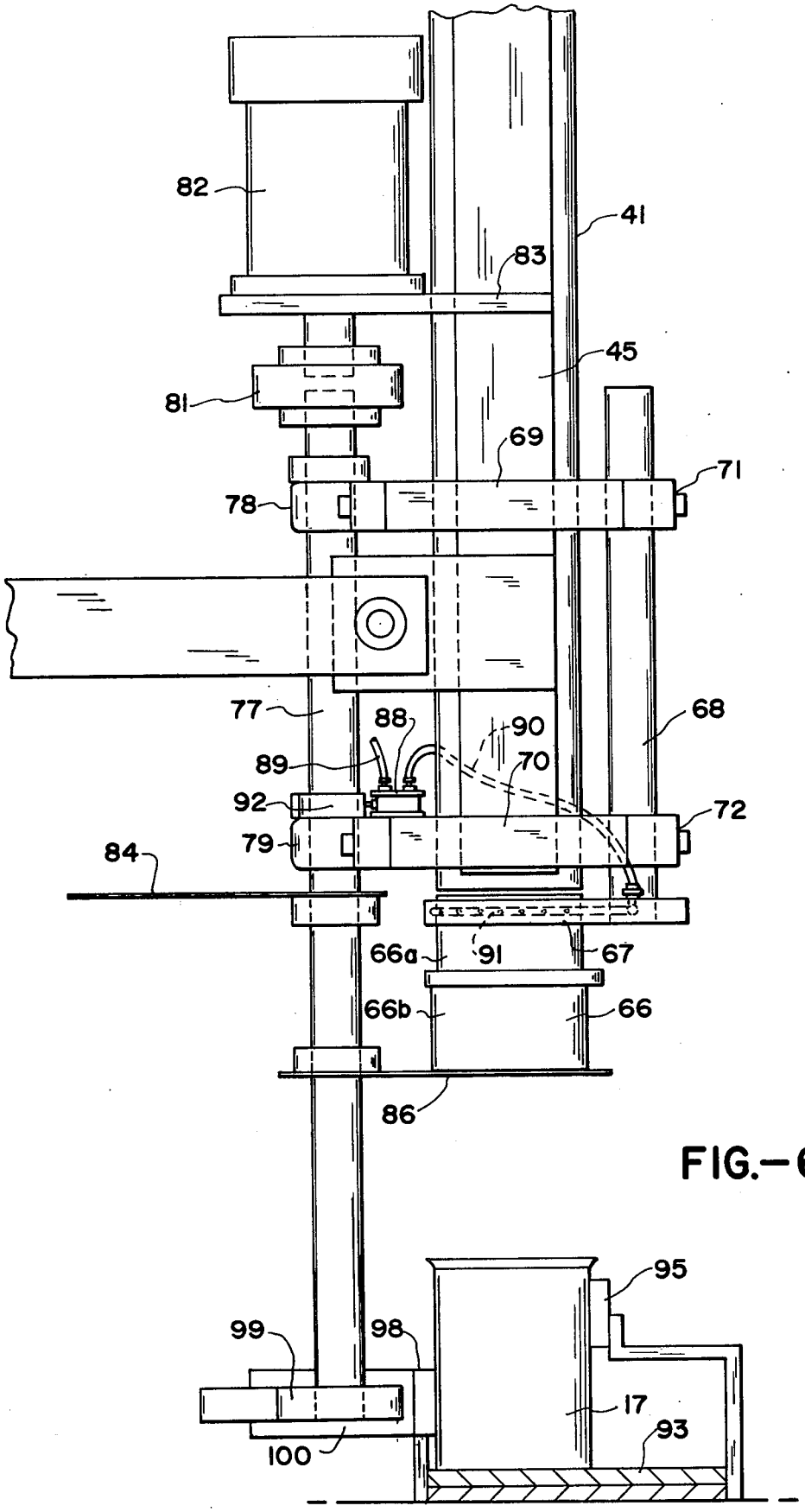
FIG. 6 is an enlarged detail showing the cut-off means and related parts.
Figure 7:
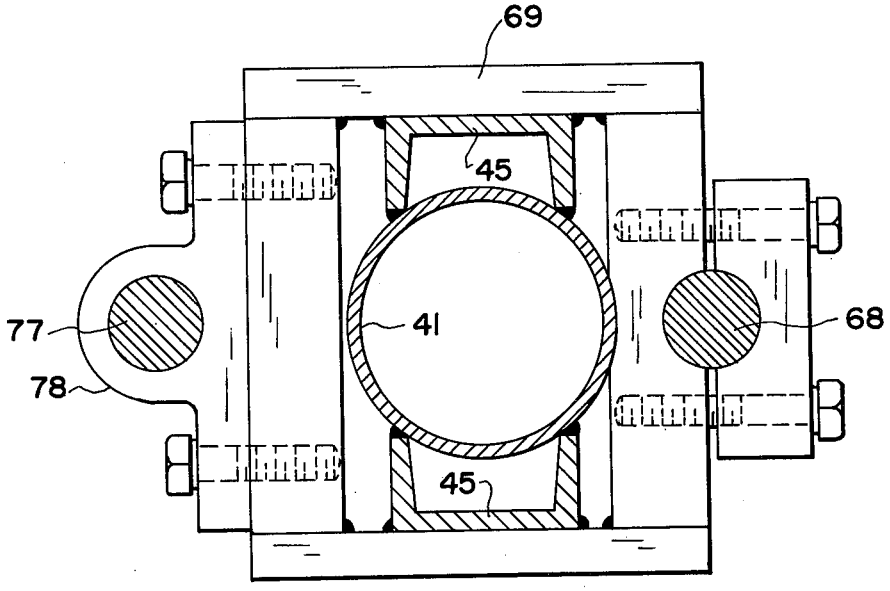
FIG. 7 is an enlarged section taken on the line 7—7 of FIG. 3.

The upper end of the filler pocket 66 is spaced a short distance from the lower end of tube 41, as shown in FIG. 6. A rotary drive shaft 77 extends along that side of the tube 41 opposite to the mounting rod 68. It is carried by bearings 78 and 79, which in turn are mounted upon the structures 69 and 70. A drive coupling 81 serves to operatively connect the upper end of shaft 77 with the shaft of a motor 82, which may be of the hydraulic fluid operated type. The motor mounting bracket 83 can be carried by the side members 45. Rotary cut-off means operates between the lower end of the tube 41 and the upper end of the filler pocket 66, and can consist of a cutting blade 84 which is directly secured to the shaft 77. Also rotary closure means operates directly below the lower end of the filler pocket 66 and consists in this instance of a plate 86 which is likewise directly secured to the shaft 77.

In operation the shaft 77 is driven continuously whereby the cutting blade 84 recurrently passes through the space between the tube 41 and the upper end of the filler pocket 66 to cut off the upper portion of the material within the pocket, and to close the lower end of the tube 41 for an interval after such cut-off. Plate 86 is likewise rotated continuously, and is positioned on the shaft 77 whereby the blade 84 completes its cutting stroke but is still functioning as a closure for tube 41, the plate 86 opens the lower end of the pocket and discharges the material into the underlying container. As shaft 77 continues to rotate, the plate 86 closes the lower end of the filler pocket 66 and blade 84 moves to open the lower end of tube 41 whereby the material moves downwardly through the tube to again fill the pocket after which the next cut-off operation occurs.

When the lower portion of the column of material within the pocket is cut off, it is desirable for the cut-off portion to move downwardly into the underlying container as quickly as possible. There is a tendency for a slight subatmospheric pressure to be developed between the lower end of the column of material and the cut-off plug, at the time the material moves downwardly, and this tends to hinder downward movement. To overcome this effect, means are provided for introducing air into the space between the cut-off plug and the lower end of the column of material immediately after cut-off and at the time the material drops downwardly into the underlying container 17. Suitable means for this purpose may include a valve 88 which is connected by pipe 89 to a source of air under pressure, and by pipe 90 to a fitting on the mounting clamp 67. Ducts 91 in the clamp 67 serve to deliver this air into the region near the upper end of the filler pocket 66, thereby preventing development of any subatmospheric pressure and in fact providing a pressure that may be above atmospheric to assist in discharging the cut-off portion. The operating member of the valve 88 can be actuated by suitable cam means 92 carried by shaft 77, whereby the air under pressure is recurrently applied through the pipe 90 in synchronism with the cut-off operation.

As shown in FIG. 6, the continuously moving can conveyor 93 may be of the belt or hinged slat type, and may be carried by guide members (not shown). The container 17 shown upon the conveyor is in can-filling position, directly below the filler pocket 66. The cans are guided by rails 95 and 96 (FIG. 4) as they approach can-filling position. When a can reaches proper filling position, it is held stationary by the stop fingers 97 (FIG. 5) for an interval sufficient for filling. The filled can is then deflected laterally by the pusher or deflector 98 which is reciprocated by cam means 99 carried by shaft 77. The pusher member 98 can be spring urged toward retracted position and slidably carried by the housing 100 (FIG. 6). Mechanism for carrying out such indexing operations are known to those familiar with can handling and conveying equipment.

Operation of the machine as disclosed in FIGS. 3 – 7 is as follows. After blanching the spinach or other leafy vegetable is fed to the conveyor 58, and elevated by this conveyor to the region of discharge above the fluffing drum 44 where it is dragged off by conveyor 63. The discharge of the material is relatively constant because of the metering effect of the inclined conveyor. The fluffing drum acts upon the material in the manner described with reference to FIGS. 1 and 2, whereby the limp leafy material in loose uncompacted form falls downwardly into the hopper 42 and into the upper end of tube 41. The tube 41 together with the parts secured to the same, including the filler pocket 66, is continuously shaken in a vertical direction whereby the material moves downwardly through tube 41 with substantially minimum friction. Immediately after the tube 41 has been substantially filled with a column of the material, the hydraulic motor 82 is put into operation whereby the shaft 77 is rotated at a constant selected speed. This causes the cutter 84 to recurrently cut through the lower portion of the column to provide a portion corresponding in height to the filling pocket 66, for filling the containers. Immediately after the blade 84 has passed through the column of material, the closure plate 86 moves to a position where it no longer closes the lower end of the pocket, and therefore the cut-off portion of the column is caused to drop downwardly into the underlying receptacle 17. Simultaneously with cutting off the lower portion of the column of material, jets of air are introduced into the space immediately below the cut-off blade 84, whereby the cut-off portion or plug is aided in its downward movement through the pocket 66 and into the receptacle 17.

The receptacles or cans 17 are moved continuously into spinach-receiving position below the filler pocket 66, and retained in such position for a sufficient length of time to receive the material. After this filling operation the cans are deflected from the dwell position and thereafter may be moved to a weighing station where the weight is checked, and any underweight or overweight cans rejected. Thereafter, the cans are sealed and retorted for heat sterilization.

During operation of the machine it is desirable to maintain the column of material in tube 41 at a substantially constant height, whereby the volume-to-weight ratio of the cut-off portion of the column remains constant. In practice, if the shaft 77 is operated at a substantially constant speed the rate of cut-off will be maintained constant. Under such conditions the feed conveyor 58 can be adjusted with respect to its driving speed, whereby the amount of material supplied to the tube serves to maintain the column of material at a substantially constant height.

Figure 8:
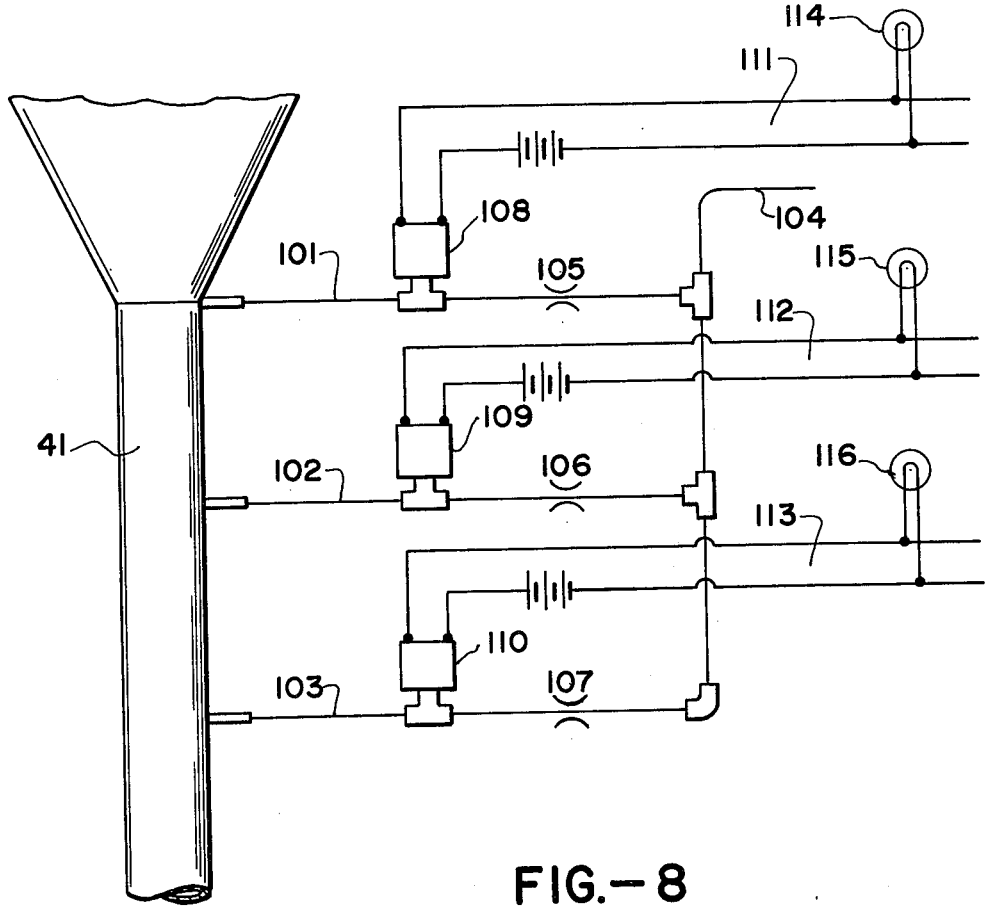
FIG. 8 schematically illustrates control means and circuitry.

Instead of relying upon the observation of an operator to effect proper control of the machine, it is desirable to provide automatic controlling means such as shown in FIG. 8. Three pipes 101, 102 and 103 are shown connected to the tube 41 at different levels through one side wall. These pipes are connected to a source of air or other gas under pressure, represented by line 104, through the flow restricting orifices 105, 106 and 107. They are also shown connected to the pressure operated switches 108, 109 and 110. The contacts of these switches serve to control the electrical circuits 111, 112 and 113. Each circuit may include suitable signalling means such as the lamps 114, 115 and 116. If the level of compacted material in the tube 41 should rise to a level above the pipe 101, then pressure builds up in this pipe to cause operation of the switch 108, with the result that the control circuit 111 is energized. This circuit preferably operates relay switch means to shut down the entire machine. Normally the control is such that the level of the compacted column in the tube 41 is intermediate the pipes 102 and 103. Under such conditions there is no back pressure build-up in pipe 101, but sufficient back pressure is built up in pipe 102 to operate the switch 109. If, however, the level of the column of material in tube 41 falls below the level of pipe 103, then no back pressure is maintained in this pipe and as a result the switch 110 is conditioned whereby the circuit 113 de-energizes the hydraulic motor 82 ad stops operation of the cut-off blade. If the level of the column rises to the level of pipe 102, back pressure is developed in this pipe sufficient to cause the switch 109 to energize circuit 112, and this in turn serves to stop the operation of the feed conveyor, as a result of which the level of the column is lowered to a point intermediate the pipes 102 and 103.

While the above described method and apparatus is particularly effective for filling containers with fresh blanched spinach, the invention is applicable to other food materials that present some of the same problems as spinach. Thus the invention can be applied to other leafy vegetables, such as cabbage, kale and collard greens which are customarily blanched before being introduced into containers. Also the invention can be applied to certain vegetables that are stringy and tend to be fluffy when fresh or after blanching, such as green beans sliced lengthwise, sauerkraut (sliced cabbage), and shoestring carrots and beets.

Figure 9:
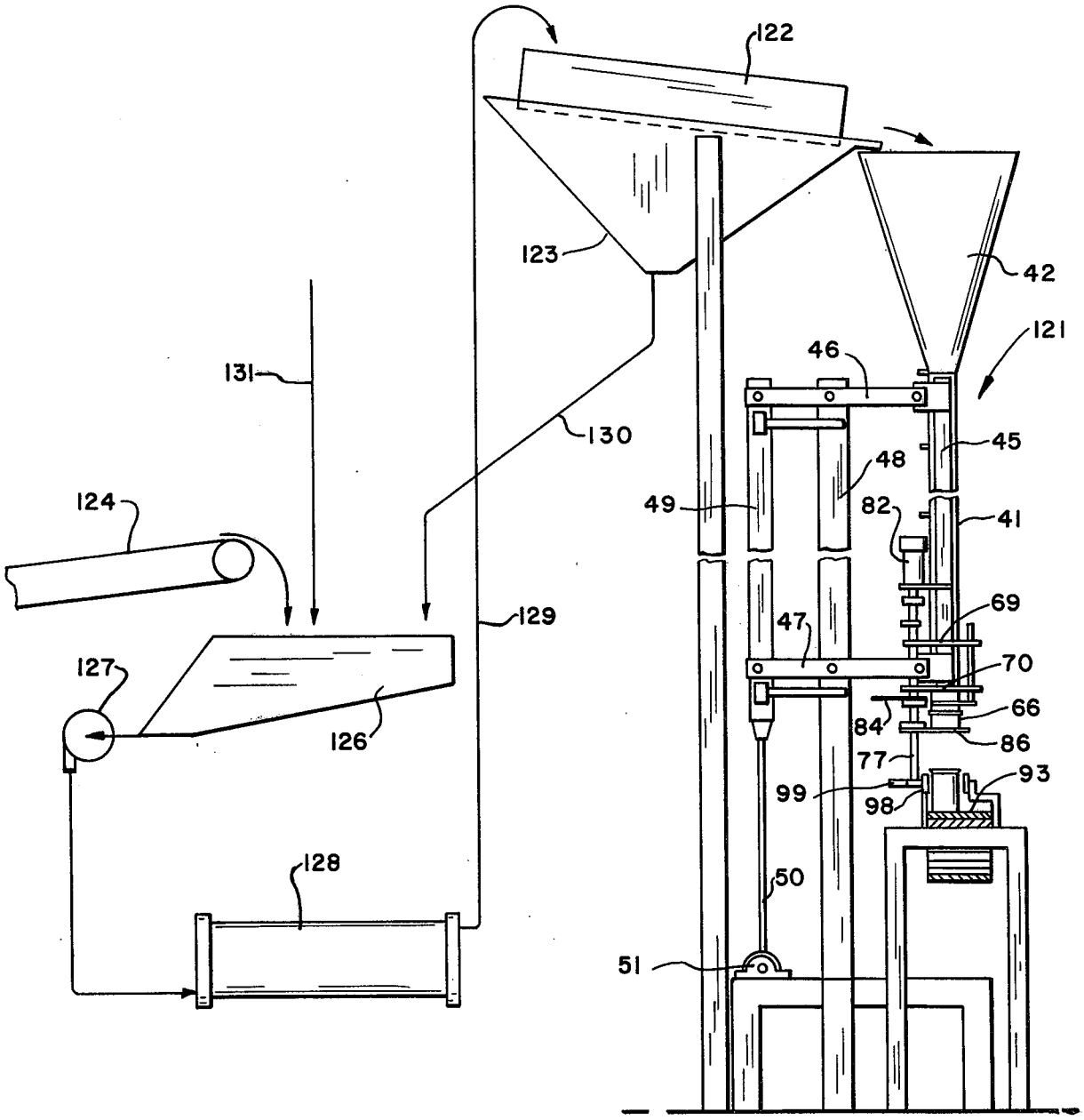
FIG. 9 is a side view in elevation showing another embodiment of the invention.

The apparatus shown in FIG. 9 has some of the features of the apparatus previously described, but certain changes have been made whereby this apparatus can be used to fill containers with other food materials, such as peaches in particulate form. The unit designated generally at 121 corresponds to the unit incorporated with the previously described embodiment, and includes the tube 41, hopper 42, and the shaking and cut-off means associated with the tube 41. However, the tube 41 may be relatively shorter than that used for material like spinach, as for example, it may be of the order of two feet in height. The fluffer that is incorporated in the previously described embodiment has been omitted, and the material is supplied to the hopper 42 by a shaker feed device 122 which may be one provided with a screen forming the bottom of the device whereby excess liquid is drained from the material. The shaker feed device is carried at the upper open end of the hopper 123, which serves to collect liquid drained from the material. Material such as sliced peaches, together with some sugar syrup in which they have been processed, is supplied by a belt conveyor 124 from preceding processing operations. The material is delivered to the tank 126 which has its lower end connected to the inlet side of the slurry pump 127. The discharge side of this pump is connected to heat exchanger 128 which has its outlet connected by pipe 129 to deliver the material to the shaker feed device 122. Line 130 represents liquid drained from the material being returned to the hopper 126. Line 131 represents introduction of additional make-up syrup into the tank 126.

Operation of the apparatus shown in FIG. 9 and the method involved are as follows. The peaches supplied by conveyor 124 have been prepared and sliced to provide pieces of such size that when mixed with a sugar syrup they can be pumped as a slurry through the heat exchanger 128. The peaches are accompanied by some sugar syrup as delivered by the conveyor 124 by virtue of their previous processing. In the tank 126 the peaches may be mixed with additional syrup supplied by way of lines 130 and 131. The resulting slurry is passed through the pump 127 and delivered through the heat exchanger 128 where the temperature is raised to a sterilizing level of the order of 205° F. The slurry leaving the heat exchanger is delivered to the shaker feed device 122, where excess syrup is drained away for return to the tank 126, and the pieces delivered at a relatively constant rate to the hopper 42. A column of material is thus formed and maintained in the tube 41 substantially as previously described, and progresses downwardly through the tube to the cut-off device. A predetermined amount of compaction occurs within the tube as in the previously described embodiment whereby a predetermined weight-to-volume ratio is maintained in the bottom of the tube. The cut-off means likewise functions as previously described whereby a section of the lower end of the column is repeatedly cut off and delivered into the underlying container.

The method involved in FIG. 9 may be used in connection with aseptic canning. In this event the temperature level of the material leaving the heat exchanger 128 is well above that required for heat sterilization whereby when the material is delivered into a container and the container immediately thereafter sealed, the residual heat is such that when held for a period of time of the order of 20 minutes or more, the container and contents are heat sterilized. Certain features of the apparatus contribute to its effectiveness when used in such a method, particularly because with respect to the material passing downwardly through the tube 41, it is possible to minimize loss of heat so that the desired sterilizing temperature can be maintained as the material is introduced into the containers and the containers sealed. In this connection, the tube 41 and the associated hopper 42 can be heat insulated. Also the apparatus provides what may be termed first-in-and-first-out handling of the material. In other words, as an increment of material enters the tube 41, material subsequently introduced into hopper 41 follows the first-in material, thus providing for uniform retention time of any portion of the material within the hopper and tube, with the result that any heat treatment of the material occurring within the tube 41 is uniformly applied.

I claim:

1. In a method of successively filling containers with wet food material, making use of a vertically extending unobstructed tube having cut-off means at its lower end, the steps of continuously supplying the material to a region above the upper open end of the tube and causing free-falling movement of the same into the upper tube portion to form a column of the material of predetermined height within the tube, continuously shaking the tube in a vertical direction to cause the column of material to move freely downwardly through the tube, causing the material in the column to be subjected only to gravity compacting pressure which gradually increases to a predetermined degree of compaction toward the lower end of the tube whereby for the lower portion of the column there is a predetermined fixed ratio of volume to weight, and recurrently cutting off lower end portions of the pressure compacted column that are of equal volume and causing such portions to be transferred to containers.

2. A method as in claim 1 in which the material is a moist limp vegetable and is continuously acted upon to break up compacted masses and to separate individual articles of the material without any substantial breakage of the same before introducing the articles into the tube.

3. A method as in claim 1 in which the material is delivered to the upper end of the tube and is transferred to containers at a sterilizing temperature of the order of 205° F.

4. A method for successively filling containers with predetermined equal volumes and weights of moist limp blanched vegetable material, the method of making use of a vertically extending unobstructed tube having closure and cut-off means at its lower end, the steps of continuously supplying the blanched vegetable material to a region generally above the upper end of the tube, continuously acting upon the material in said region to break up compacted masses and to separate individual articles of the material without substantial breakage of the same, causing the resulting loose, uncompacted material freely to fall by gravity into the upper end of the unobstructed tube and to form therein a column of material within the tube which extends from the lower portion of the tube to an upper level short of the upper end, continuously subjecting the tube to mechanical shaking in a vertical direction to cause the material to progress freely downwardly through the unobstructed tube, the material in the column being subjected by gravity to compacting pressure which gradually increases to a predetermined degree of compacting pressure toward the lower end of the tube whereby for the lower portion of the column there is a predetermined ratio of volume to weight, and recurrently cutting off lower end portions of the column of equal value and causing such portions to be transferred to containers.

5. A method as in claim 4 in which the material is fed to the step of continuously acting upon the material at a controlled rate serving to maintain the height of the column of material substantially constant.

6. An apparatus for filling containers with predetermined amounts of a food material, a vertically disposed unobstructed tube having an upper open end, means for supplying material to a region above the upper end of the tube whereby the material is caused to drop by gravity into the tube to form a vertical column of material therein, a filler pocket below the lower end of the tube and attached thereto for receiving a predetermined volume of material from the tube, cut-off means at the lower end of the tube and connected thereto for recurrently cutting off material in the filler pocket to provide measured masses for filling the containers, a supporting frame, means connecting the assembly comprising the tube and filler pocket and cut-off means to the frame, said last means permitting vertical movement of the assembly, and means for continuously shaking the tube together with the filler pocket and the cut-off means in a vertical direction.

7. Apparatus as in claim 6 in which the means for supplying material to the upper end of the tube includes means serving to break up compacted masses of the material and to separate individual articles without any substantial breakage of the same, whereby the material falls downwardly in loose uncompacted form into the upper end of the tube.

8. Apparatus as in claim 7 in which the means for supplying the material includes a first conveyor for continuously supplying the material to a region above the means for breaking up compacted masses, and a second rake off conveyor overlying the discharge portion of the first conveyor and serving to assist in the discharge of material therefrom.

9. Apparatus as in claim 7 in which the means for breaking up compacted masses comprises a drum having radially extending members and rotatable about a horizontal axis, said members serving to engage and break apart compacted masses of the material and to separate individual articles without substantial breakage of the same.

10. Apparatus as in claim 9 together with means connecting the drum to the frame, said last means permitting vertical movement of the drum, and means for shaking the drum in a vertical direction.

11. Apparatus as in claim 6 in which the cut-off means at the lower end of the tube includes a cut-off blade adapted to operate between the filler pocket and the lower end of the tube, a closure plate at the lower end of the filler pocket, and drive means for cyclically operating the cut-off blade and the closure plate whereby immediately after a cut-off operation the closure plate is moved to permit the cut-off portion of the material to drop out of the filler pocket.

12. In apparatus for successively filling containers with predetermined amounts of food material, a vertically disposed unobstructed tube having an upper open end, means for supplying material to a region above the upper end of the tube whereby the material is caused to drop by gravity into the tube to form a vertical column of material therein, a filler pocket below the lower end of the tube for receiving a predetermined volume of material from the tube, cut-off means at the lower end of the tube for recurrently cutting off material in the filler pocket to provide measured masses for filling the containers, means for continuously shaking the tube together with the filler pocket and the cut-off means in a vertical direction and control means responsive to changes in the height of the column of material below a predetermined limit to interrupt operation of the cut-off means and control means responsive to changes in the height of the column above a predetermined limit to reduce the supply of material to the region at the upper end of the tube.

13. Apparatus as in claim 12 in which the cut-off means at the lower end of the tube includes a cut-off blade adapted to operate between the filler pocket and the lower end of the tube, a closure plate at the lower end of the filler pocket, and drive means for cyclically operating the cut-off blade and the closure plate whereby immediately after a cut-off operation the closure plate is moved to permit the cut-off portion of the material to drop out of the filler pocket, together with means for introducing jets of air into a region between the lower end of the tube and the upper portion of the filler pocket.

14. A method for successively filling containers with predetermined amounts of moist limp vegetable material, the method making use of a vertically extending tube having closure and cut-off means at its lower end, the steps of continuously supplying vegetable material to a region generally above the upper end of the tube, continuously acting upon the material in said region to break up compacted masses and to separate individual articles of the material, causing the resulting loose uncompacted material to fall by gravity into the upper end of the tube to form therein a column of material within the tube, continuously subjecting the tube to mechanical shaking in a vertical direction to cause the material to progress freely downwardly through the tube, recurrently cutting off the lower end portions of the column and causing such portions to be transferred to containers, and immediately after the lower portion of the column has been cut off causing a stream of air to be introduced into the region between the cut-off portion and the adjacent lower end of the column, thereby assisting in the discharge of the cut-off portion.

15. In a method for successively filling containers with predetermined amounts of wet food material making use of a vertically disposed unobstructed tube having an upper open end together with a filler pocket and cut-off means below the lower end of the tube, the steps of continuously supplying the wet food material to a region above the upper end of the tube whereby the food material falls freely into the upper end of the tube to form a column of material therein, continuously shaking the tube and the filler pocket in a vertical direction whereby the column of material moves freely through the tube and into the filler pocket with gradual compaction increasing to a predetermined degree at the lower end of the tube, causing the material in the filler pocket to be cyclically cut off from the lower portion of the column and to be discharged into a container, and reducing the supply of material to the region at the upper end of the tube when the height of the column exceeds a predetermined limit.

* * * * *